US007056140B1

(12) United States Patent
Jiang

(10) Patent No.: US 7,056,140 B1
(45) Date of Patent: Jun. 6, 2006

(54) ZERO-INSERTION-FORCE CONNECTOR STRUCTURE

(75) Inventor: Jong-Shiun Jiang, Taipei (TW)

(73) Assignee: Starlink Electronics Corp., Taipei Hsien (TW)

( * ) Notice: Subject to any disclaimer, the term of this patent is extended or adjusted under 35 U.S.C. 154(b) by 0 days.

(21) Appl. No.: 11/228,421

(22) Filed: Sep. 19, 2005

(30) Foreign Application Priority Data

Apr. 15, 2005 (TW) ..... 94205890 U
May 30, 2005 (TW) ..... 94117616 A

(51) Int. Cl.
*H01R 13/625* (2006.01)

(52) U.S. Cl. ..... 439/342

(58) Field of Classification Search ..... 439/342, 439/259, 264–266, 268
See application file for complete search history.

(56) References Cited

U.S. PATENT DOCUMENTS 6,338,640 B1 * 1/2002 Lin ..... 439/342
6,450,825 B1 * 9/2002 Huang ..... 439/342
6,450,827 B1 * 9/2002 Huang et al. ..... 439/342
6,475,013 B1 * 11/2002 Pang et al. ..... 439/342
6,500,019 B1 * 12/2002 Tan ..... 439/342
6,579,112 B1 * 6/2003 Nobuyuki et al. ..... 439/342
6,609,926 B1 * 8/2003 Chen et al. ..... 439/342
6,663,409 B1 * 12/2003 Liao et al. ..... 439/342
6,669,498 B1 * 12/2003 Okita et al. ..... 439/342
6,669,500 B1 * 12/2003 Ju ..... 439/342
6,676,431 B1 * 1/2004 Kukita et al. ..... 439/342
6,692,281 B1 * 2/2004 McClinton et al. ..... 439/342
6,692,282 B1 * 2/2004 Ye et al. ..... 439/342
6,712,634 B1 * 3/2004 McClinton ..... 439/342
6,743,039 B1 * 6/2004 Shirai et al. ..... 439/342
6,796,826 B1 * 9/2004 Hirata ..... 439/342
6,840,788 B1 * 1/2005 Ju ..... 439/342
6,910,908 B1 * 6/2005 Tran et al. ..... 439/342
6,921,276 B1 * 7/2005 McClinton ..... 439/342
6,929,498 B1 * 8/2005 Tan ..... 439/342
6,960,095 B1 * 11/2005 Hirata et al. ..... 439/342
2002/0155743 A1 * 10/2002 Kukita et al. ..... 439/342
2003/0068917 A1 * 4/2003 Shirai et al. ..... 439/342
2003/0186578 A1 * 10/2003 McClinton ..... 439/342
2003/0228785 A1 * 12/2003 Okita et al. ..... 439/342
2004/0002246 A1 * 1/2004 Liao et al. ..... 439/342
2004/0002247 A1 * 1/2004 Okita et al. ..... 439/342
2004/0067674 A1 * 4/2004 Hirata et al. ..... 439/342
2004/0087199 A1 * 5/2004 Tran et al. ..... 439/342
2004/0102074 A1 * 5/2004 Kukita et al. ..... 439/342
2004/0115982 A1 * 6/2004 Zeng et al. ..... 439/342
2004/0147155 A1 * 7/2004 Hirata et al. ..... 439/342
2004/0219817 A1 * 11/2004 Ju ..... 439/342
2004/0229493 A1 * 11/2004 He et al. ..... 439/342
2005/0042908 A1 * 2/2005 Sun et al. ..... 439/342
2005/0042909 A1 * 2/2005 Sun ..... 439/342
2005/0064754 A1 * 3/2005 Tan ..... 439/342
2005/0186809 A1 * 8/2005 Lei et al. ..... 439/68
2005/0186827 A1 * 8/2005 He et al. ..... 439/342
2005/0196989 A1 * 9/2005 Lei et al. ..... 439/148
2005/0215094 A1 * 9/2005 He et al. ..... 439/110
2005/0215102 A1 * 9/2005 Yu et al. ..... 439/342

* cited by examiner

*Primary Examiner*—Ross Gushi
(74) *Attorney, Agent, or Firm*—Leong C. Lei

(57) ABSTRACT

A zero-insertion-force connector structure is provided herein. The major characteristic of the invention is to have a reinforcing plate configured inside the body of the connector so as to, along with the related cam, positioning plate, etc., avoid the deformation of the connector under excessive force and provide more sensible operation.

8 Claims, 14 Drawing Sheets

ZERO-INSERTION-FORCE CONNECTOR STRUCTURE

BACKGROUND OF THE INVENTION

1. Technical Field of the Invention

The present invention generally relates to connectors and, more particularly, to zero-insertion-force connectors for mounting computer chips on circuit boards.

2. Description of the Prior Art

Zero-Insertion-Force (ZIF) connectors are commonly used in installing a central processing unit (CPU) on a circuit board. As the computing power of the CPUs is continuously enhanced, the pins of the CPUs are also significantly increased in numbers. The increased number of CPU pins requires the exertion of additional force so as to mount the CPU in a ZIP connector. Additionally, as customers continuously demand the electronic device to be even smaller, the ZIP connector has to be reduced in size as well. Together these present the following challenges to the conventional ZIP connectors.

As shown in FIG. 14, a ZIP connector for use in a notebook computer has a cam 70 configured at a side of the ZIF connector. When the cam 70 is rotated by a screw driver, the cover plate 71, with the CPU 60 on top of the cover plate 71, would horizontally slide relative to the body 72 of the ZIP connector, so that the pins of the CPU 60 could establish electrical contacts to the pin holes of the body 72. A user has to exert additional force to overcome the larger resistance resulted from the increased number of CPU pins. If too much force is exerted, a phenomenon shown in FIG. 13 would occur. As illustrated, if the cam 70 is not reliably positioned, the excessive force would cause a biased torque to the cam 70, displacing the axis of the cam 70 and resulting gaps S1 and S2 between the cam 70 and the body 72, and between the cam 70 and the cover plate 71, respectively. In the mean time, the body 72 and the cover plate 71 would suffer deformation, and the electrical contacts between the CPU pins and the pin holes would also be affected, or even disrupted.

In other words, if the cover plate 71 and the body 72 are made of plastic while the cam 70 is made of a metallic material, excessive force applied to the cam 70 when the cover plate 71 has already reached its terminal location would easily deform the cover plate 71 and/or the body 72. At least, the axial hole for the cam 70 would be widened or damaged.

SUMMARY OF THE INVENTION

The primary purpose of the present invention is to obviate the foregoing problems; a ZIF connector structure is disclosed herein. One of the major characteristics of the present invention is having a reinforcing plate configured inside the body of the ZIF connector. The reinforcing plate has a through hole allowing the cam of the ZIF connector to pass through. The through hole has a ring flange to confine the cam so that the cam wouldn't deviate under excessive force. The reinforcing plate is also configured with bended legs for embedding into the body of the ZIF connector so as to avoid the deformation of the cover plate of the ZIF connector.

Another characteristic of the present invention is having a positioning plate configured with a through hole for the insertion of the cam. The positioning plate has a number of wedges configured so that, when the cam is rotated in either direction, the cam would be stopped by one of the wedges.

As such, the cam has a very clear range of rotation to avoid the exertion of excessive force.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
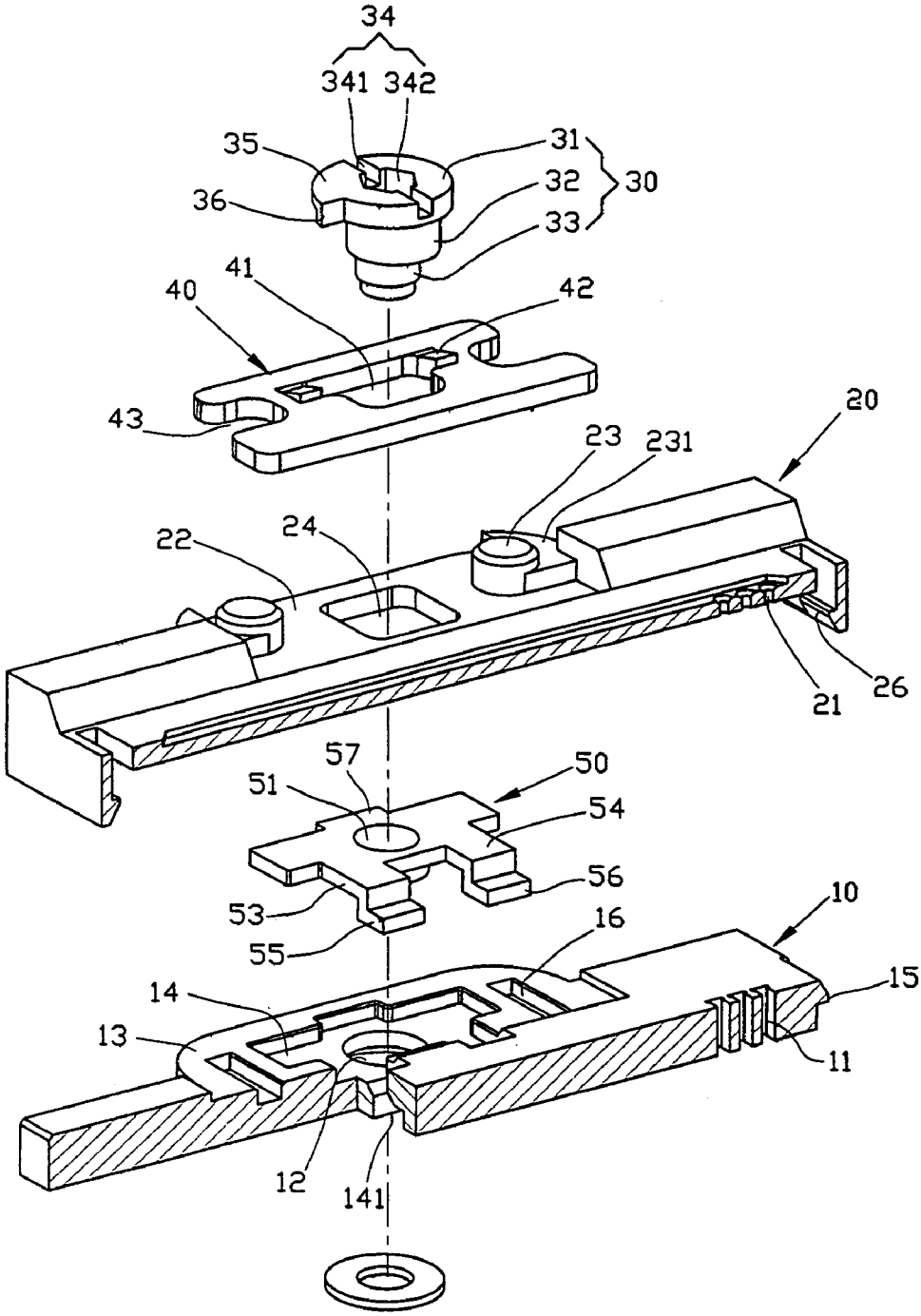
FIG. 1 is a perspective view showing the various parts of the ZIF connector according to the present invention.
Figure 6:
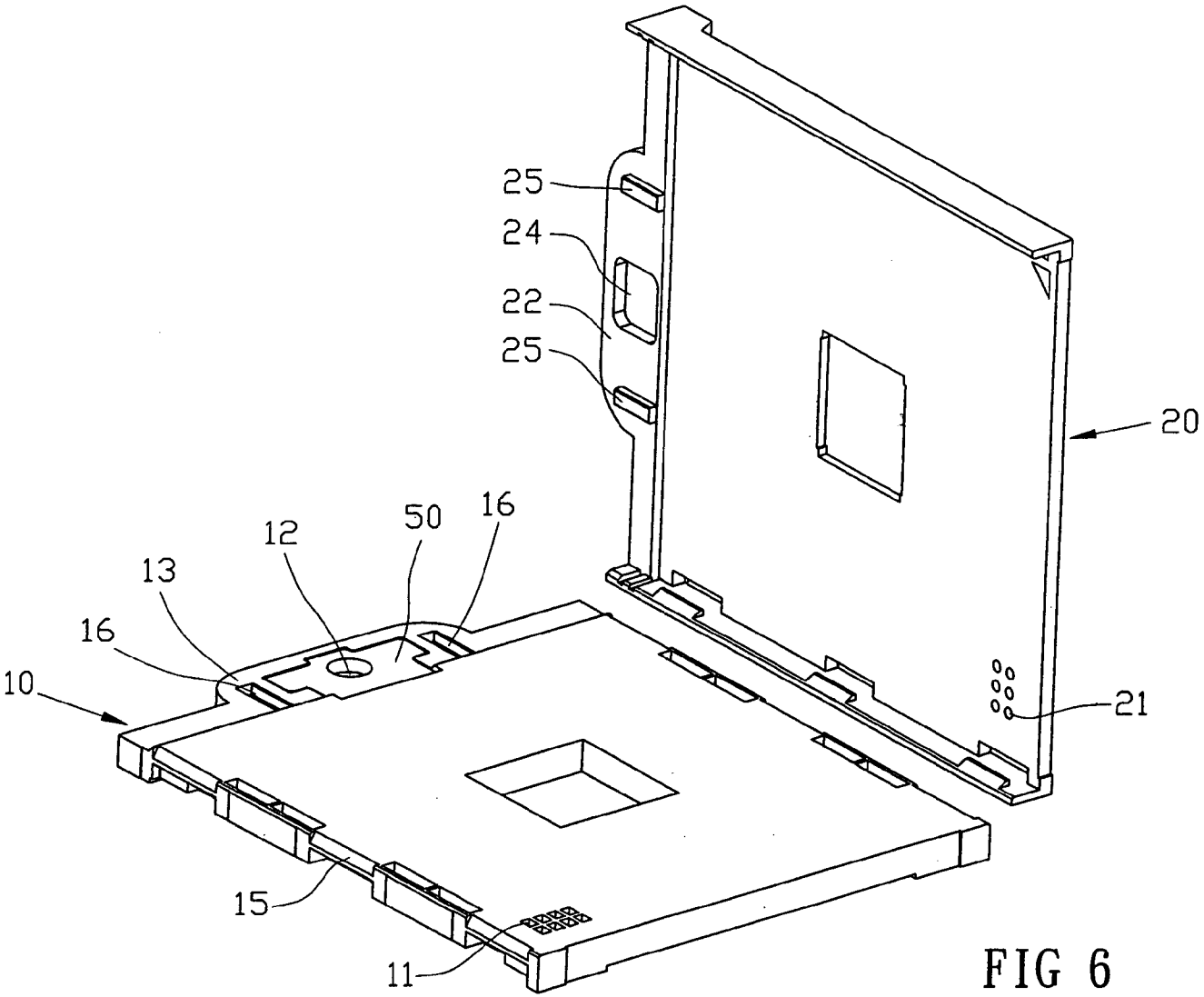
FIG. 6 is a perspective view showing the cover plate and the body according to the present invention.

Please refer to FIGS. 1 and 6. The present invention has a rectangular body 10 with a large number of pin holes 11 for the insertion of a chip's pins. Along two opposing sides of the body 10, there are a number of hooks 15 and, along one of the other two sides, there is a platform 13 extended outward to have a sunken tray 14 with a through hole 12 in the center. The platform 13 has at least a ladder-like through passage 141 penetrating through the body 10 along the side of the sunken tray 14 closer to the body 10. The platform 13 has two elongated notches 16 along two opposing sides of the tray 14 respectively, parallel to the two sides of the body 10 having the hooks 15.

Figure 7:
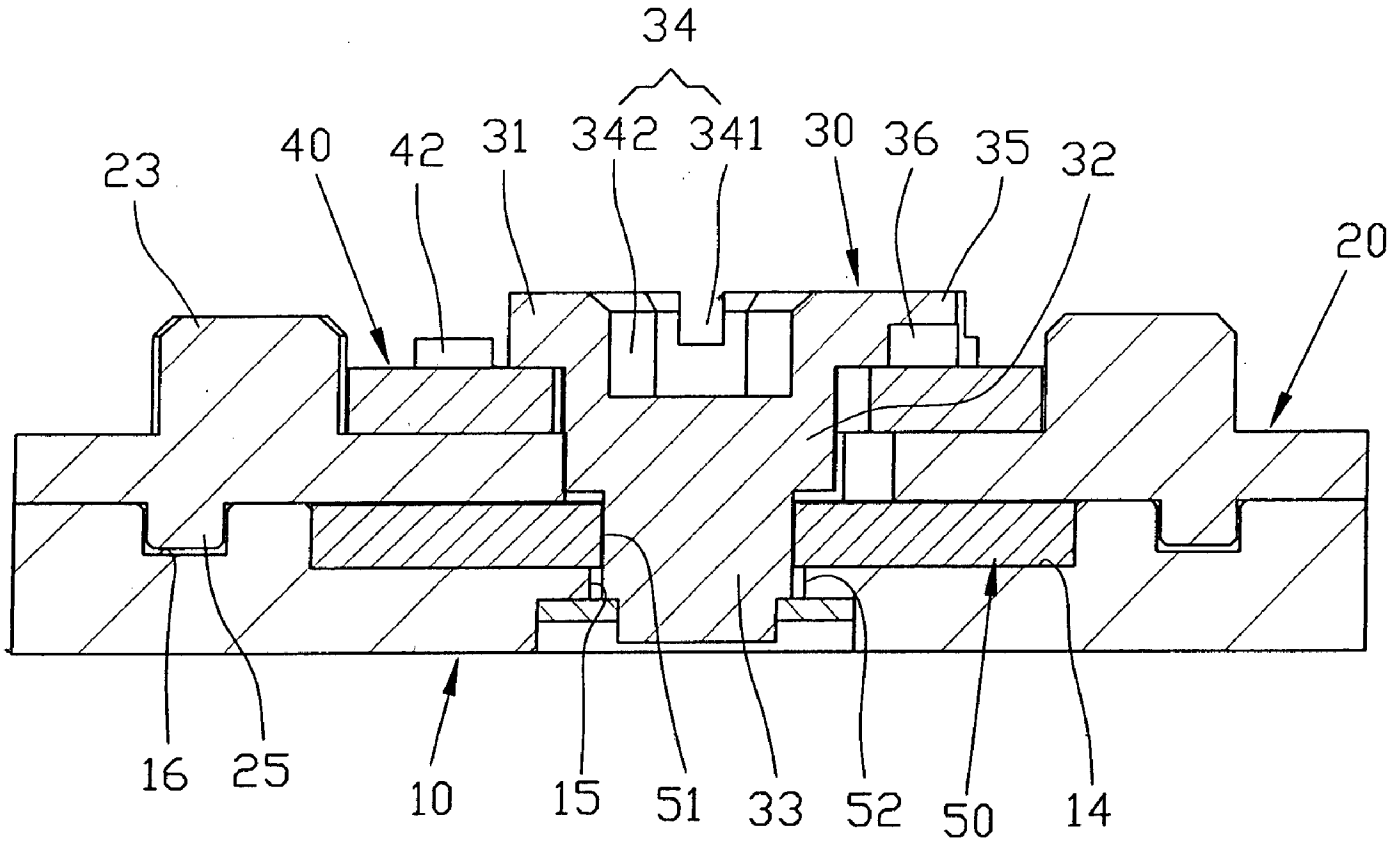
FIG. 7 is a section view showing the inner structure of the present invention along the x—x line of FIG. 2.
Figure 8:
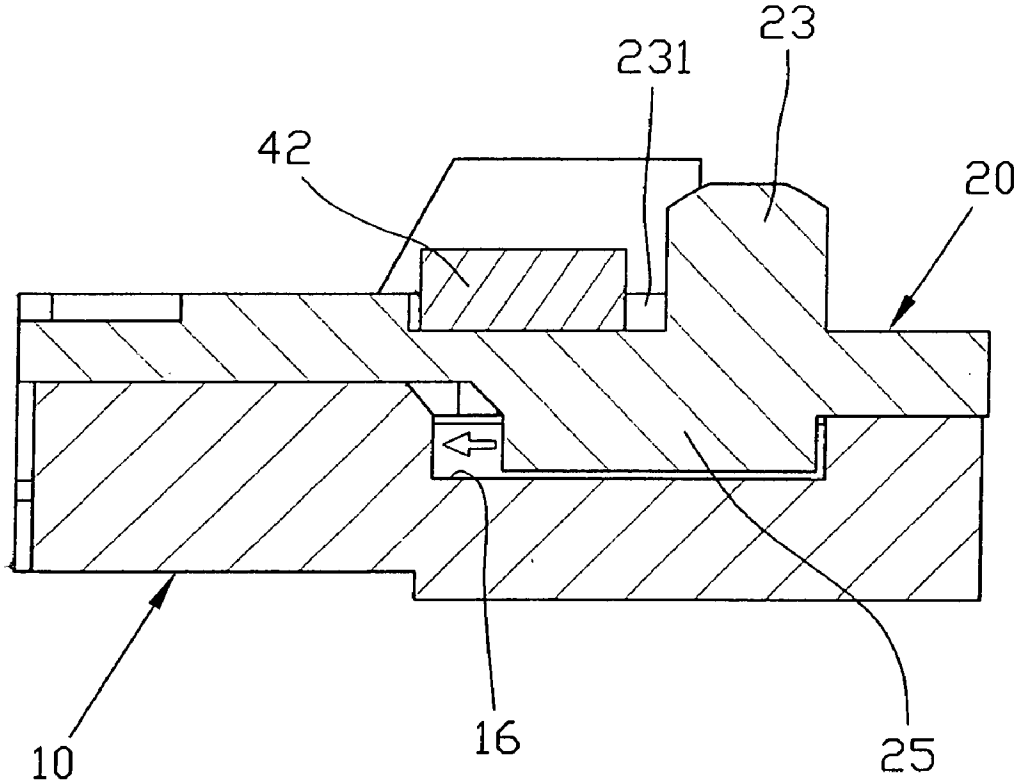
FIG. 8 is a section view showing the inner structure of the present invention along the a—a line of FIG. 2.

A cover plate 20 corresponding to the body 10 has pin holes 21, a platform 22, and clasps 26 at matching locations to the pin holes 11, platform 13, and hooks 15 of the body 10, respectively. The claps 26 and the hooks 15 join the cover plate 20 and the body 10 tightly together. The platform 22 also has a rectangular through hole 24 in the center and two protruding blocks 25 corresponding to the notches 16. The length of the protruding blocks 25 is smaller than that of the notches 16 so that the blocks 25, as shown in FIGS. 7 and 8, could be fit inside the notches 16 and, when the cover plate 20 slides relatively to the body 10, the cover plate 20 could move reliably along the direction P1 as shown FIG. 2 without deviation. Please refer to FIG. 1 again. The platform 22 has protruding cylindrical positioning columns 23 with stoppers 231 along a portion of their circumferences so that a positioning plate 40 could be fixed on the platform 22 with correct orientation.

Figure 2:
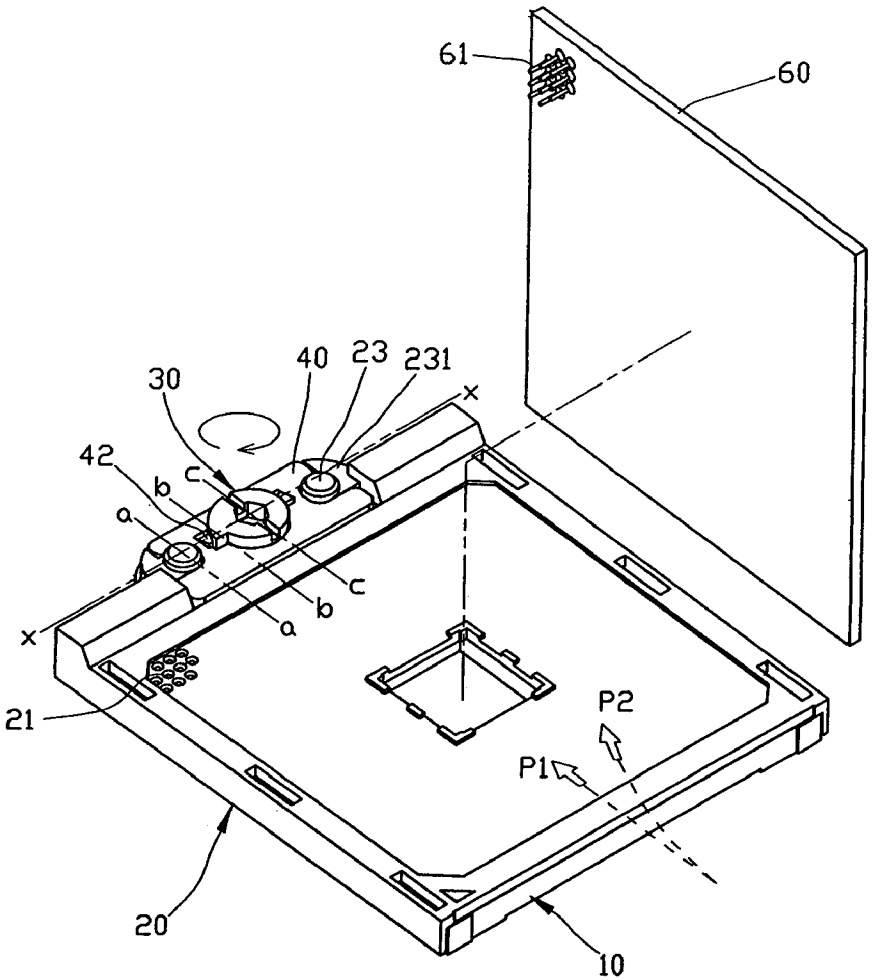
FIG. 2 is a perspective view showing the body according to the present invention.

The positioning plate 40 is made of a material stronger than plastic such as a metallic material. Besides a center through hole 41, as shown in FIGS. 1 and 2, the positioning plate 40 has two concaves 43 for the accommodation of the positioning columns 23 so that the center through hole 41 is aligned with the through hole 24. The positioning plate 40 also has two wedges 42 configured along two opposing sides of the through hole 41 adjacent to the concaves 43.

Figure 11:
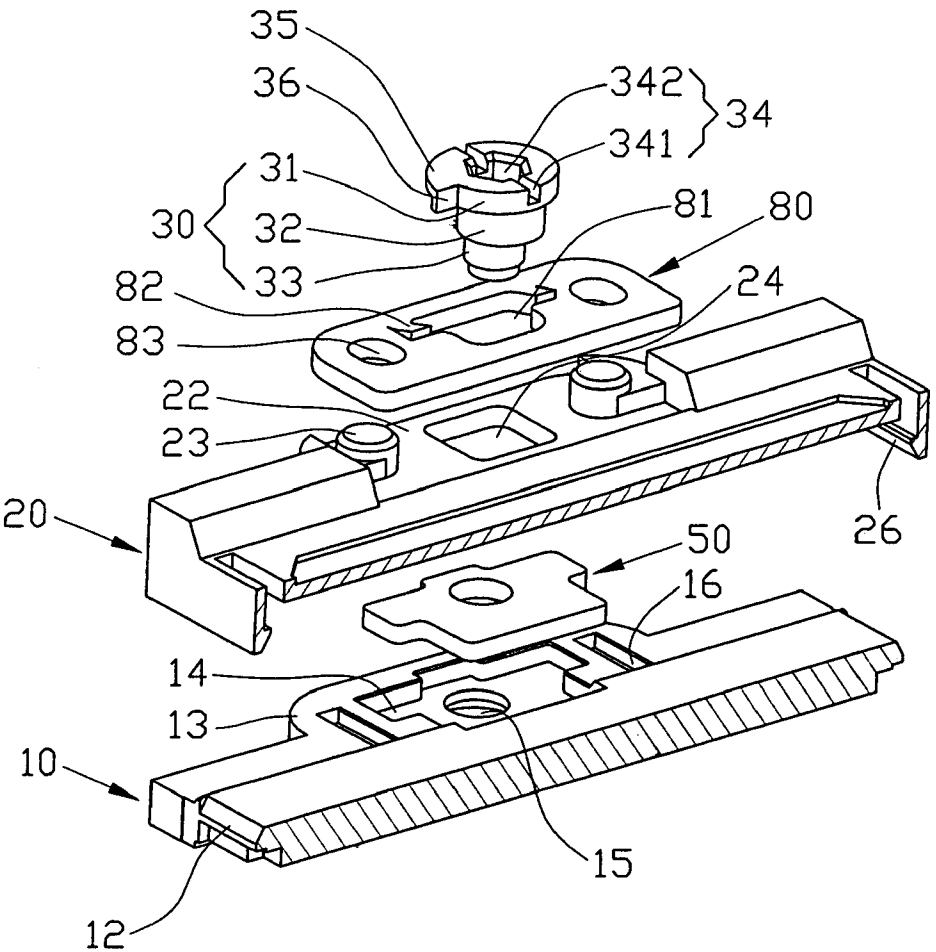
FIG. 11 shows another embodiment of the positioning plate according to the present invention.
Figure 12:
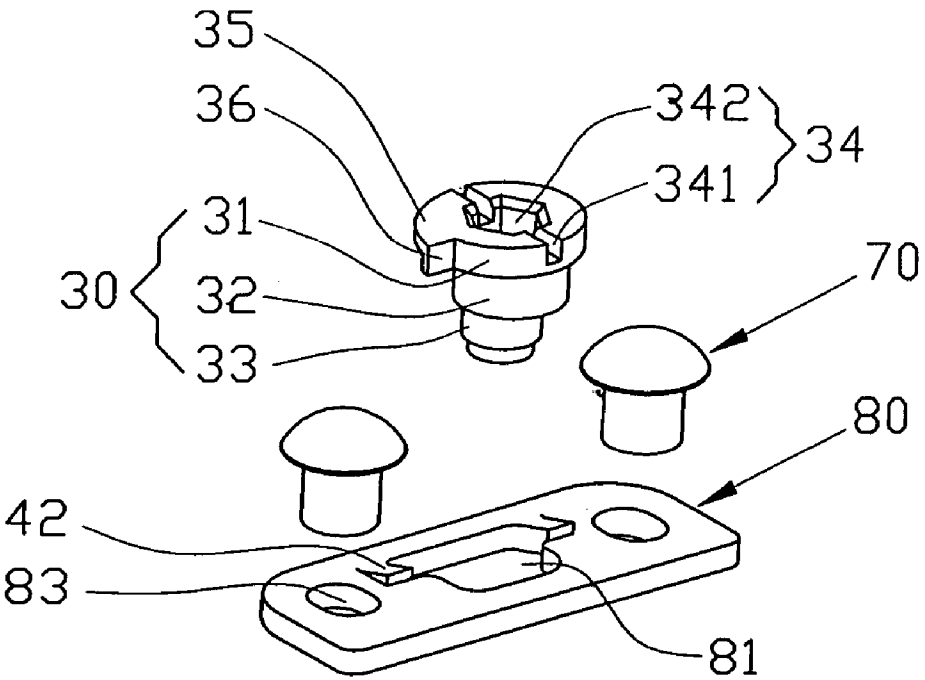
FIG. 12 shows yet another embodiment of the positioning plate according to the present invention.
Figure 13:
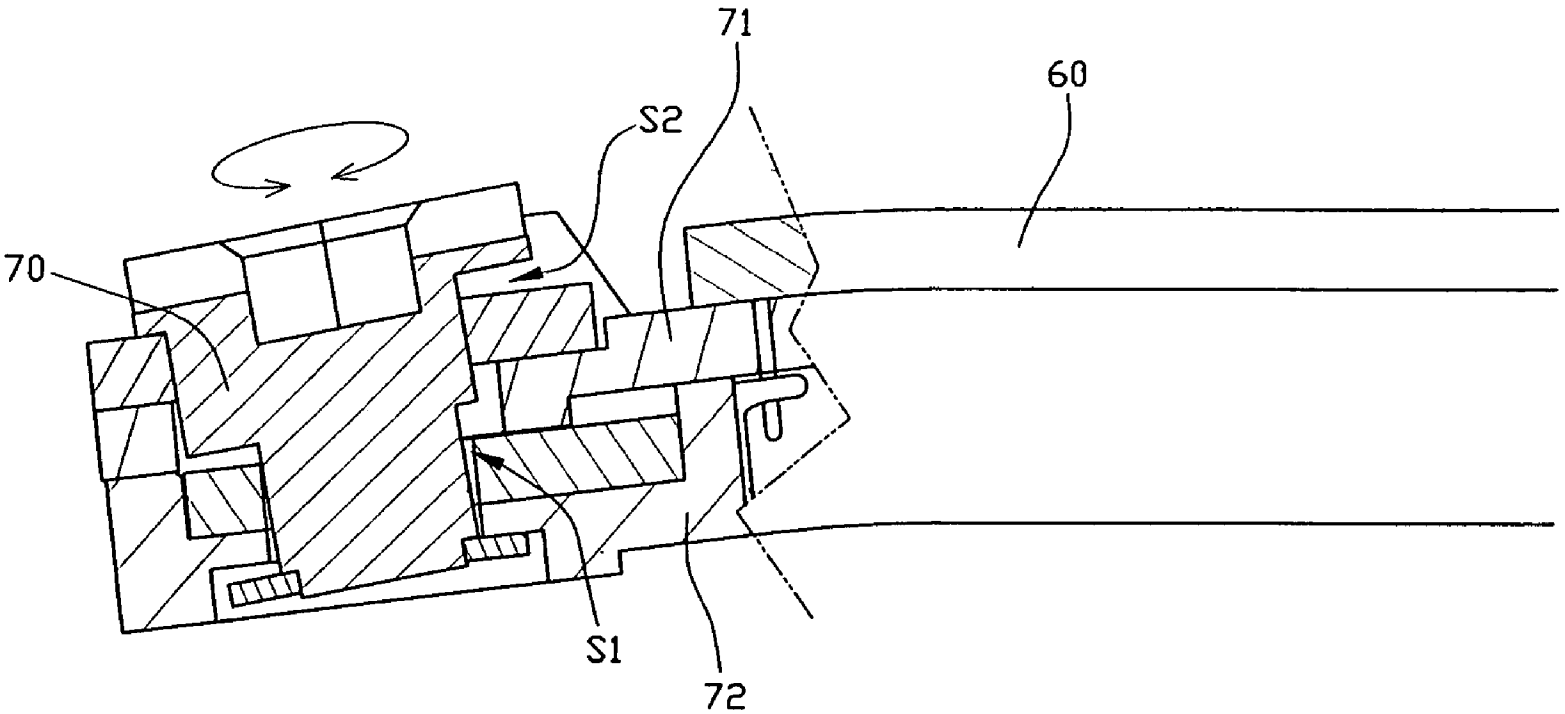
PRIOR ART FIG 13
FIG. 13 is a sectional view showing the deformation of a conventional ZIF connector when the cam is rotated with excessive force.
Figure 14:
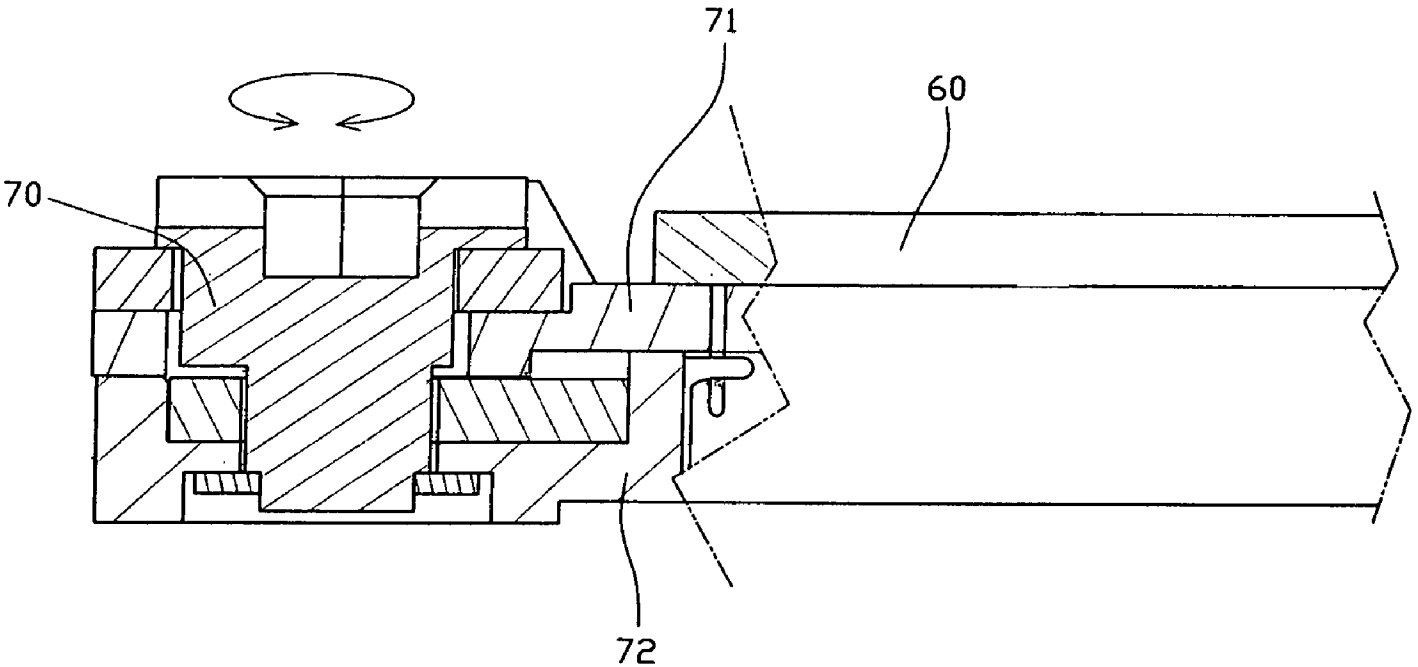
PRIOR ART FIG 14
FIG. 14 is a sectional view showing a conventional ZIF connector before the cam is rotated.

FIG. 11 shows another embodiment of the positioning plate. As illustrated, the positioning plate 80 has through holes 83 for the penetration of the protruding columns 23. FIG. 12 shows yet another embodiment of the positioning plate in which bolts 70, instead of protruding columns 23, are used to fasten the positioning plate 80 to the top cover 20 through the through holes 83.

Figure 3:
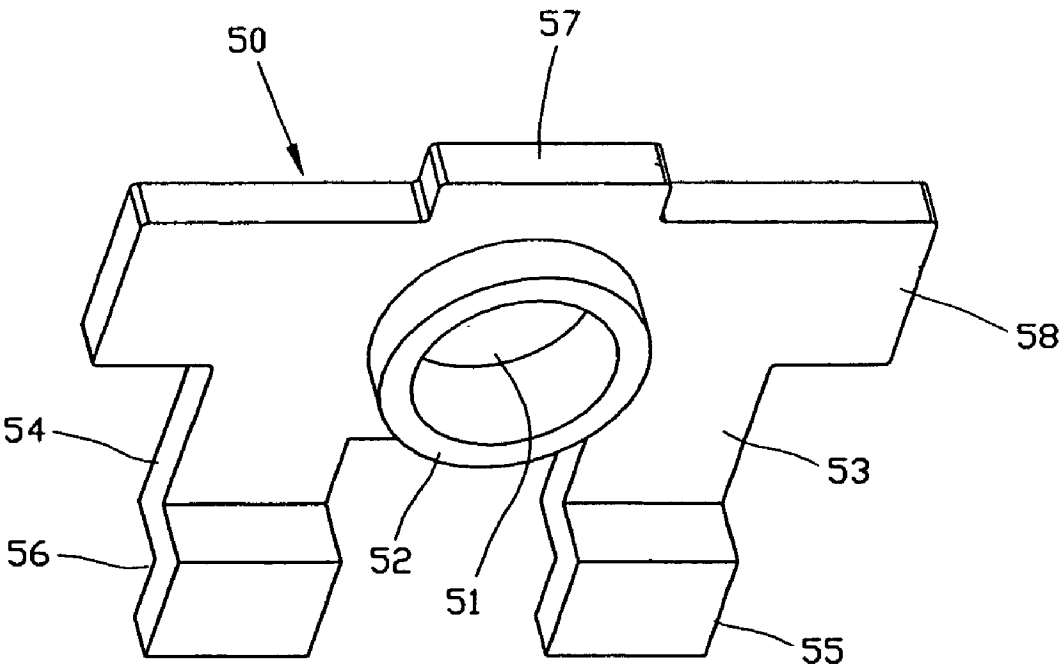
FIG. 3 is a perspective view showing the reinforcing plate according to the present invention.
Figure 4:
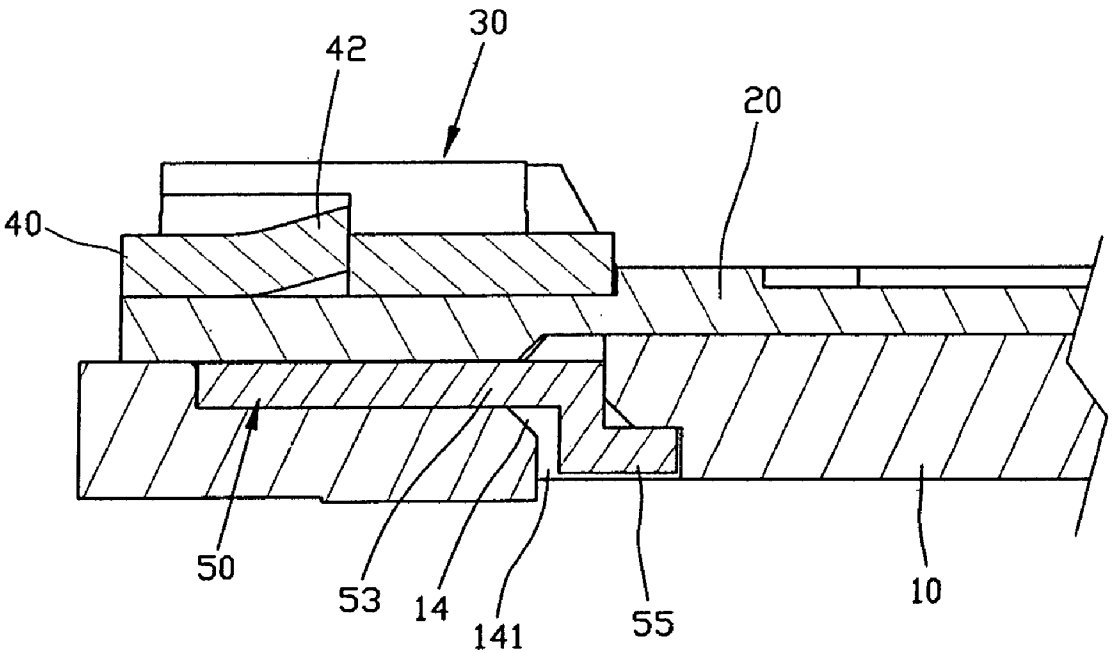
FIG. 4 is a section view showing the inner structure of the present invention along the b—b line of FIG. 2.

Please refer to FIGS. 1, 3, and 4. The reinforcing plate 50 is best made of a metallic material. The reinforcing plate 50 has a through hole 51 at an appropriate location with a ring flange 52 protruding from at least one of the reinforcing plate 50's two flat surfaces. As such, the depth of the through hole 51 is the sum of the thickness of the reinforcing plate 50 and the height of the ring flange 52. At a side of the reinforcing plate 50, there are legs 53 and 54, both with ladder-like bended sections 55 and 56 at the ends respectively. There are also extended sections 57 and 58 on the other sides of the reinforcing plate 50 so that the reinforcing plate 50 could be fitted reliably into the sunken try 14 of the body 10.

Please see FIGS. 1 and 4. When the reinforcing plate 50 is fitted inside the sunken tray 14, the bended section 55 and 56 of the two legs 53 and 54 are inserted into the ladder-like through passages 141.

Figure 5:
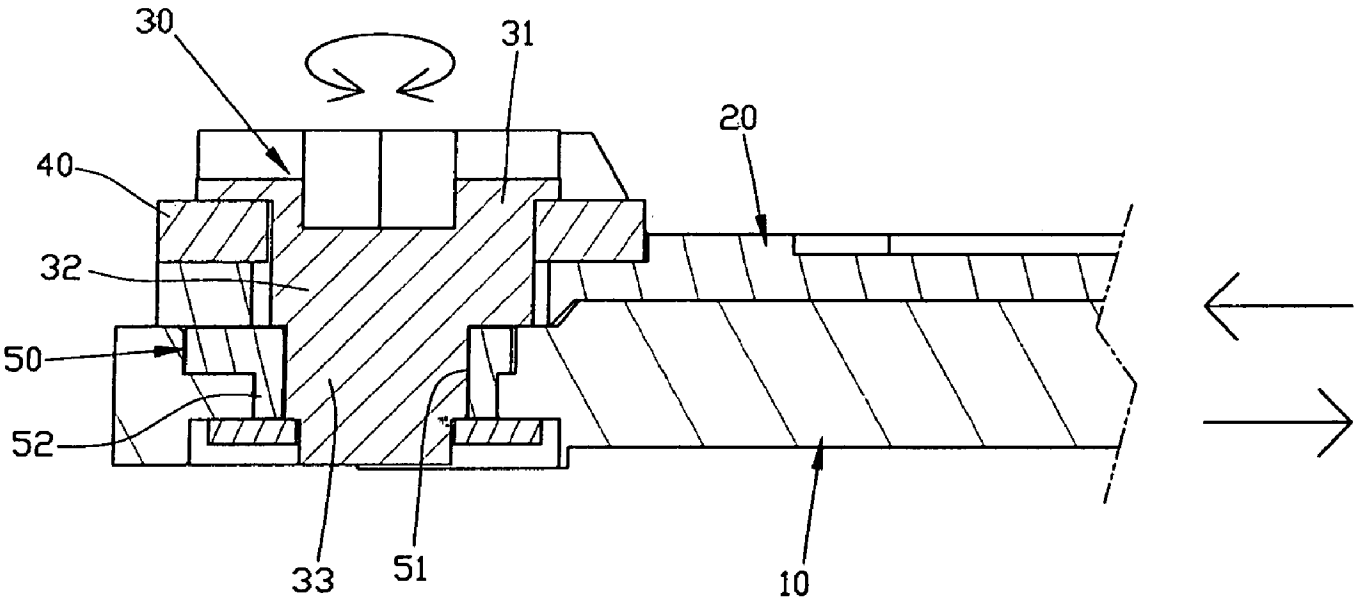
FIG. 5 is a section view showing the inner structure of the present invention along the c—c line of FIG. 2.

Please see FIGS. 1, 2, and 5. A cam 30 contains a circular upper section 31, an eccentric middle section 32, and an axial bottom section 33. On top of the upper section 31, there is a diametric groove 34 containing a linear segment 341 and a hexagonal center 342. In an alternative embodiment, two linear segments are configured to form an X shape with a hexagonal center. The circumference of the upper section 31 has an extended section 35 and thereby forms a stopper 36.

Figure 9:
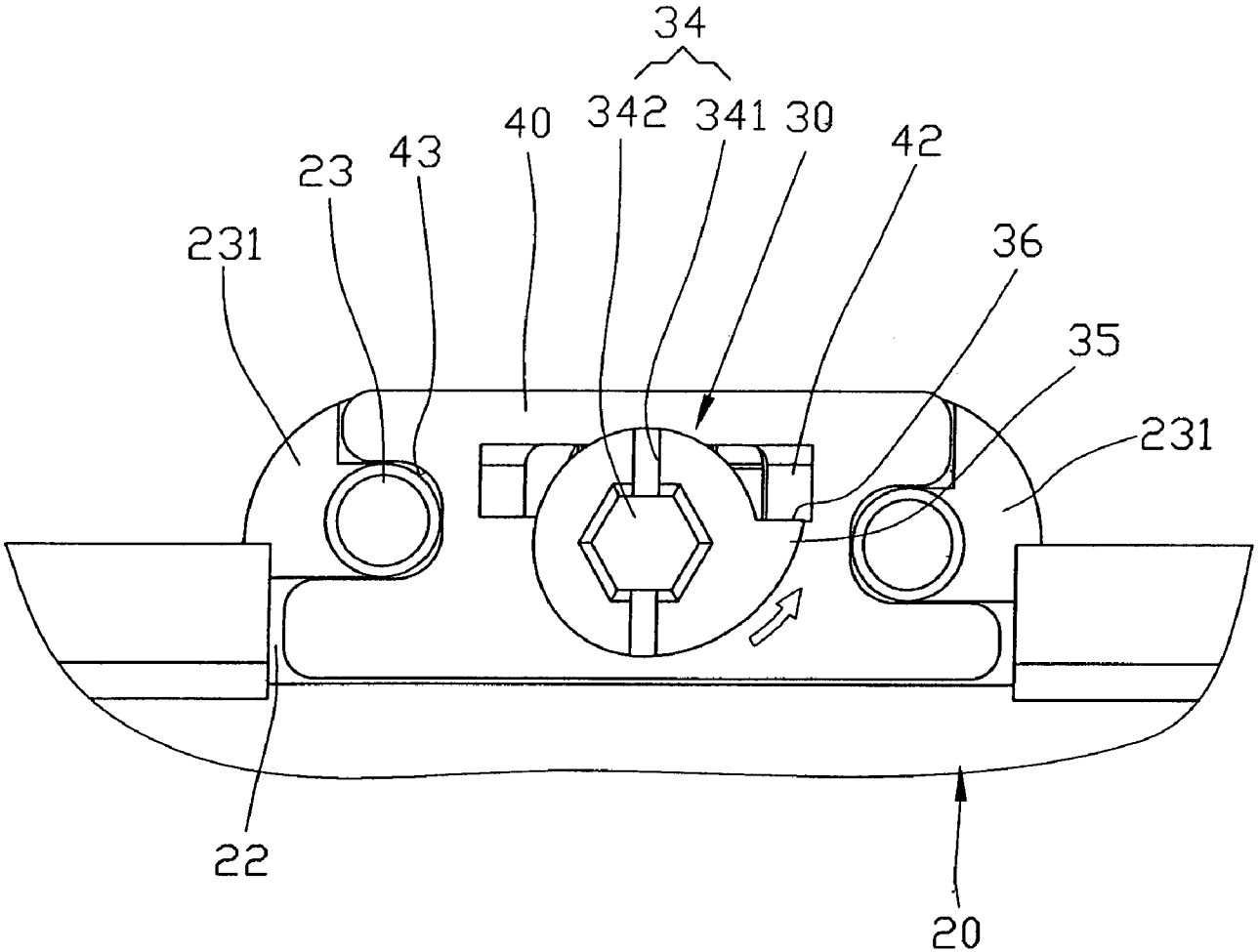
FIG. 9 is a top view showing the cam according to the present invention is rotated in one direction.
Figure 10:
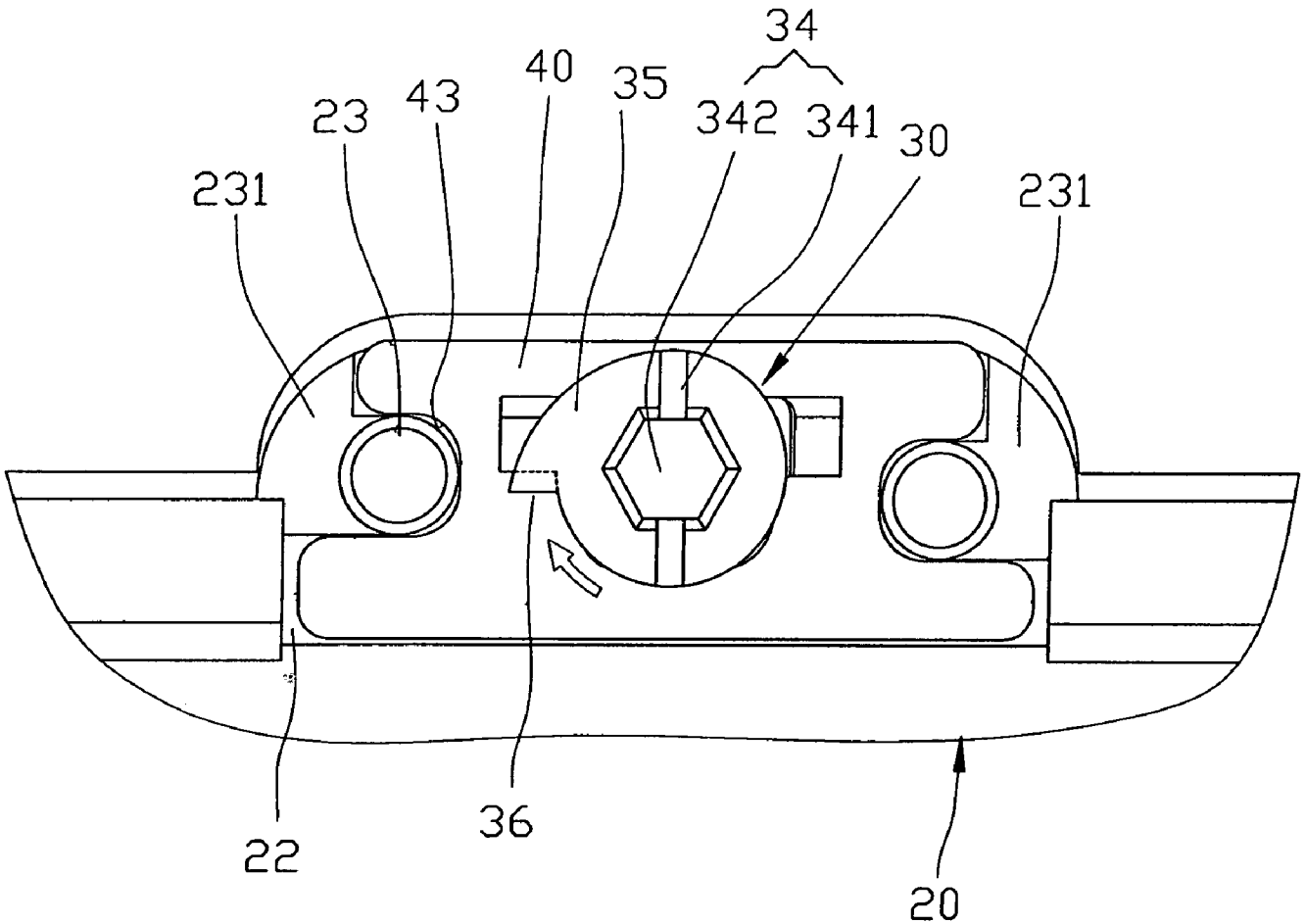
FIG. 10 is a top view showing the cam according to the present invention is rotated in the other direction.

Please see FIGS. 1, 2, and 7. The cam 31 has its middle and bottom sections 32 and 33 inserted into the through holes 41, 24, 51, and 12, and fixed by rivet, C-shaped ring, or E-shaped ring. The upper section 31 rests upon the positioning plate 40. As shown in FIGS. 1 and 9, when the cam 31 is rotated in one direction, one of the wedges 42 would collide with the stopper 36 of the extended section 35 and the cam 31 could not be rotated further. When this happens, the eccentric middle section 32 would have forced the cover plate 20 to slide to one of its terminal locations. On the other hand, as shown in FIG. 10, when the cam 31 is rotated in the other direction, the stopper 36 of the extended section 35 would be stopped by the other wedges 42 and the eccentric middle section 32 would have forced the cover plate 20 to slide to the other terminal location. As such, the cam 31 has a clear range of rotation to avoid the application of excessive force.

Please refer to FIGS. 1, 4, and 5. As the cam 31 is inserted through the through hole 51 of the reinforcing plate 50, the bottom section 33 of the cam 31 is confined by the ring flange 52 so that the cam 31 couldn't be displaced easily, enhancing the cam 31 to be more resilient to the external torque. In addition, by fitting the bended sections 55 and 56 inside the ladder-like passages 141, the reinforcing plate 50 more reliably clings to the body 10 which has a better rigidity. The cam 31 is therefore provided with a better support, which in turn prevents the cover plate 20 from deformation and tilting.

The advantages of the present invention could be summarized as follows. First of all, the ring flange of the reinforcing plate equivalently extends the thickness of the reinforcing plate so that the cam is reliable confined in its position. This not only prevents the cam from deviation, but also indirectly prevents the cover plate from deformation and tilting.

Secondly, by embedding the bended legs of the reinforcing plate into the body, the stability of the reinforcing plate is significantly enhanced, which in turn provides a reliable support to the cam. As such, when the cam is rotated, the deformation and tilting of the cover plate is prevented.

Thirdly, the positioning plate is directly configured on top of the body, which could be easily accessed and maintained. The protruding wedges provide effective confinement to the cam's rotational range.

Additionally, the protruding blocks of the cover plate and the notches of the body allow the cover plate to slide more reliably and accurately.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ZIF connector structure comprising a cover plate and a body which could slide relative to each other, said cover plate and said body having corresponding pin holes and corresponding platforms extended from the same side of said cover plate and said body, said platforms having corresponding through holes allowing a cam to pass through, said cam configured such that said cam could push said cover plate or said body to slide when said cam is rotated;

wherein said body has a sunken tray around said through hole of said body; said sunken tray having ladder-like passages through said body; a reinforcing plate placed inside said sunken tray; said reinforcing plate having a through hole allowing said cam to pass through with a ring flange extended from one of the flat surfaces of said reinforcing plate so that a height of said through hole is greater than the thickness of said reinforcing plate; said reinforcing plate configured with legs at a side of said reinforcing plate; said legs having bended sections at the ends of said legs; said bended sections being embedded inside said passages.

2. The ZIF connector structure according to claim 1, wherein said ring flange is extended from the bottom side of said reinforcing plate.

3. The ZIF connector structure according to claim 1, wherein the number of said legs of said reinforcing plate is two.

4. The ZIF connector structure according to claim 1, wherein the ends of said legs are bended to have a ladder shape.

5. The ZIF connector structure according to claim 1, wherein corresponding notches and protruding blocks are configured on said cover plate and said body facing toward each other respectively so as to guide the slide of said cover plate or said body.

6. The ZIF connector structure according to claim 1, wherein a metallic positioning plate is positioned on top of said platform of said cover plate; said positioning plate having a through hole allowing said cam to pass through; and said positioning plate having wedges configured at the two sides of the said through hole of said positioning plate.

7. The ZIF connector structure according to claim 1, said cam comprises a circular upper section, a middle eccentric section, and a bottom axial section; said upper section has a groove comprising a diametric linear segment with a hexagonal center; and said upper section has an extended section to be blocked by said wedges.

8. The ZIF connector structure according to claim 1, said cam comprises a circular upper section, a middle eccentric section, and a bottom axial section; said upper section has a groove comprising two diametric linear segments forming an X shape with a hexagonal center and said upper section has an extended section to be blocked by said wedges.

* * * * *